US012422213B2

(12) United States Patent
Liu

(10) Patent No.: US 12,422,213 B2
(45) Date of Patent: Sep. 23, 2025

(54) ARROW MAGAZINE REPLACING DEVICE

(71) Applicant: Chi-Chang Liu, Taichung (TW)

(72) Inventor: Chi-Chang Liu, Taichung (TW)

(73) Assignee: POE LANG ENTERPRISE CO., LTD., Taichung (TW)

( * ) Notice: Subject to any disclaimer, the term of this patent is extended or adjusted under 35 U.S.C. 154(b) by 188 days.

(21) Appl. No.: 18/539,267

(22) Filed: Dec. 14, 2023

(65) Prior Publication Data

US 2025/0198723 A1 Jun. 19, 2025

(51) Int. Cl.
*F41B 5/12* (2006.01)
*F41B 5/14* (2006.01)

(52) U.S. Cl.
CPC ..... *F41B 5/148* (2013.01); *F41B 5/126* (2013.01)

(58) Field of Classification Search
CPC .. F41B 5/148; F41B 5/126; F41B 5/14; F41B 5/1403; F41B 11/55
USPC ..... 124/45, 49, 86
See application file for complete search history.

(56) References Cited

U.S. PATENT DOCUMENTS

| | | | | |
|---|---|---|---|---|
| 6,868,845 | B1 * | 3/2005 | Moore | F41B 5/10 124/25 |
| 8,898,946 | B1 * | 12/2014 | Johnson | F41A 17/36 42/49.02 |
| 2015/0027426 | A1 * | 1/2015 | Isabelle | F41B 11/52 124/80 |
| 2020/0300575 | A1 * | 9/2020 | Zuo | A63H 33/18 |
| 2022/0113107 | A1 * | 4/2022 | Liu | F41B 5/126 |
| 2022/0412687 | A1 * | 12/2022 | Liu | F41B 5/126 |

* cited by examiner

*Primary Examiner* — John E Simms, Jr.

(57) ABSTRACT

An arrow magazine replacing device disposed on an arrow portion of a bow unit is provided. The arrow magazine replacing device includes: a frame member, mounted on the arrow portion of the bow unit, the frame member includes a mounting part being hollow on one side toward the other side; and an arrow magazine unit, detachably assembled and disassembled in the mounting part. In which, the arrow magazine unit can be detachably assembled and disassembled on the frame member without extra tools.

12 Claims, 13 Drawing Sheets

ARROW MAGAZINE REPLACING DEVICE

FIELD OF THE DISCLOSURE

The present disclosure is related to an arrow magazine replacing device, and more particularly to the technology applied in the field of archery. The present disclosure allows the user to quickly replace the next arrow magazine filled with arrows after running out of the arrows, so that the shooting can be continued in the shortest time to maintain the best shooting condition and stability.

BACKGROUND OF THE DISCLOSURE

In the conventional art, there are arrow magazines on the market that can be assembled on bows and accommodate multiple arrows, such as TW I778575, entitled "arrow magazine device with positioning arrows," and TW I738463 "Crossbow arrow loading device", etc. These arrow magazine devices can accommodate more arrows so that the user can maintain the most stable state for repeating shooting. However, there is still a certain limit to the number of arrows accommodated in the arrow magazine. When all the arrows in the arrow magazine are used up, the user must spend time and effort to disassemble the arrow magazine and fill the new arrows into the arrow magazine, and then assemble the arrow magazine back on the bow. In this way, filling of arrows and assembling the arrow magazine are still time-consuming, and also affect the accuracy and stability of shooting.

Furthermore, if the arrow magazine is not assembled properly, the position where the arrow falls will be affected, which may cause a shooting offset. Therefore, relevant industries are trying to provide a method or a device to solve the above problems.

SUMMARY OF THE DISCLOSURE

The present disclosure is to provide the user with the shortest and fastest replacement of the arrow magazine during repeating archery. There is no need to disassemble the arrow magazine with extra tools, and through a simple push, turn, and pull, the arrow magazine can be replaced, which greatly shortens the arrow magazine replacement time. For the user, the status can be kept by just replacing the arrow magazine, the arrow magazine unit replacement time can be shortened, and the stability and accuracy during shooting can be maintained.

Therefore, in order to achieve the above-mentioned objectives and effects, an arrow magazine replacing device disposed on an arrow portion of a bow unit is provided. The arrow magazine replacing device includes a frame member, mounted on the arrow portion of the bow unit, the frame member includes a mounting part being hollow on one side toward the other side; and an arrow magazine unit, detachably assembled and disassembled in the mounting part. In which, the arrow magazine unit can be detachably assembled and disassembled on the frame member, so that the arrow magazine replacement time can be shortened, and stability and accuracy during shooting can be maintained.

BRIEF DESCRIPTION OF THE DRAWINGS

The described embodiments may be better understood by reference to the following description and the accompanying drawings in which.

DETAILED DESCRIPTION OF THE EXEMPLARY EMBODIMENTS

Figure 1:
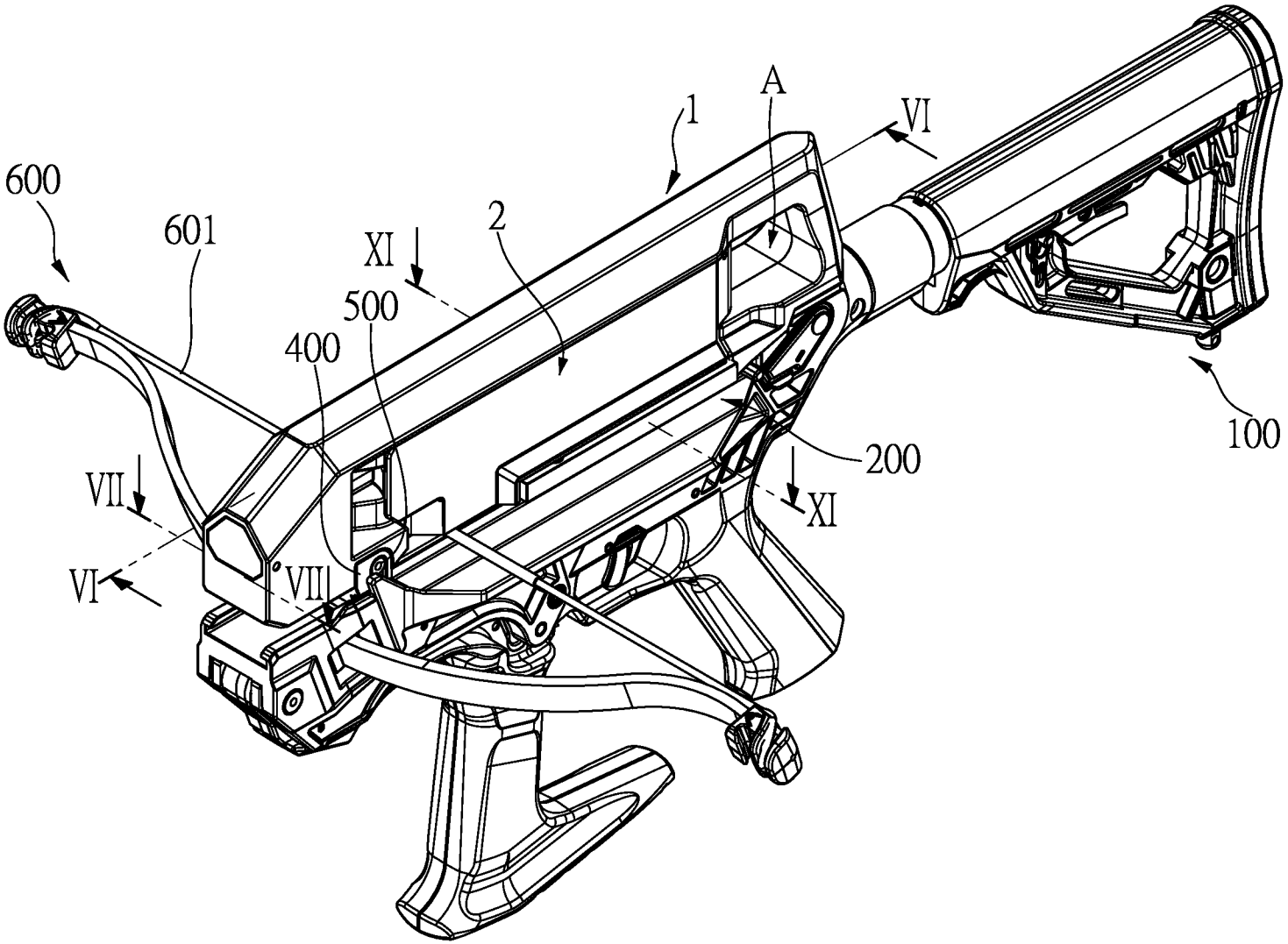
FIG. 1 is a perspective schematic view of one embodiment applied on a bow unit of the present disclosure.
Figure 1A:
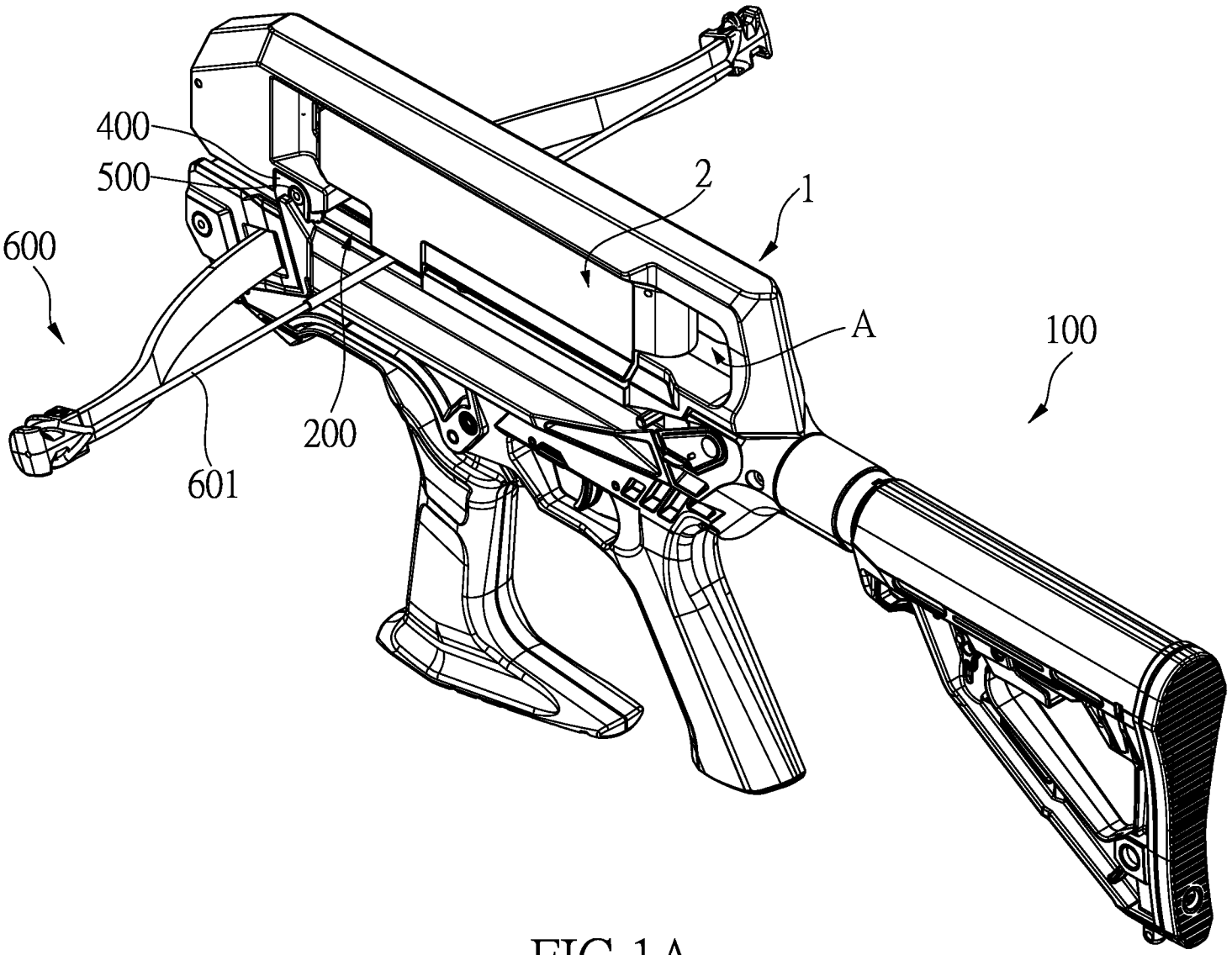
FIG. 1A is a perspective schematic view of another angle of FIG. 1.
Figure 2:
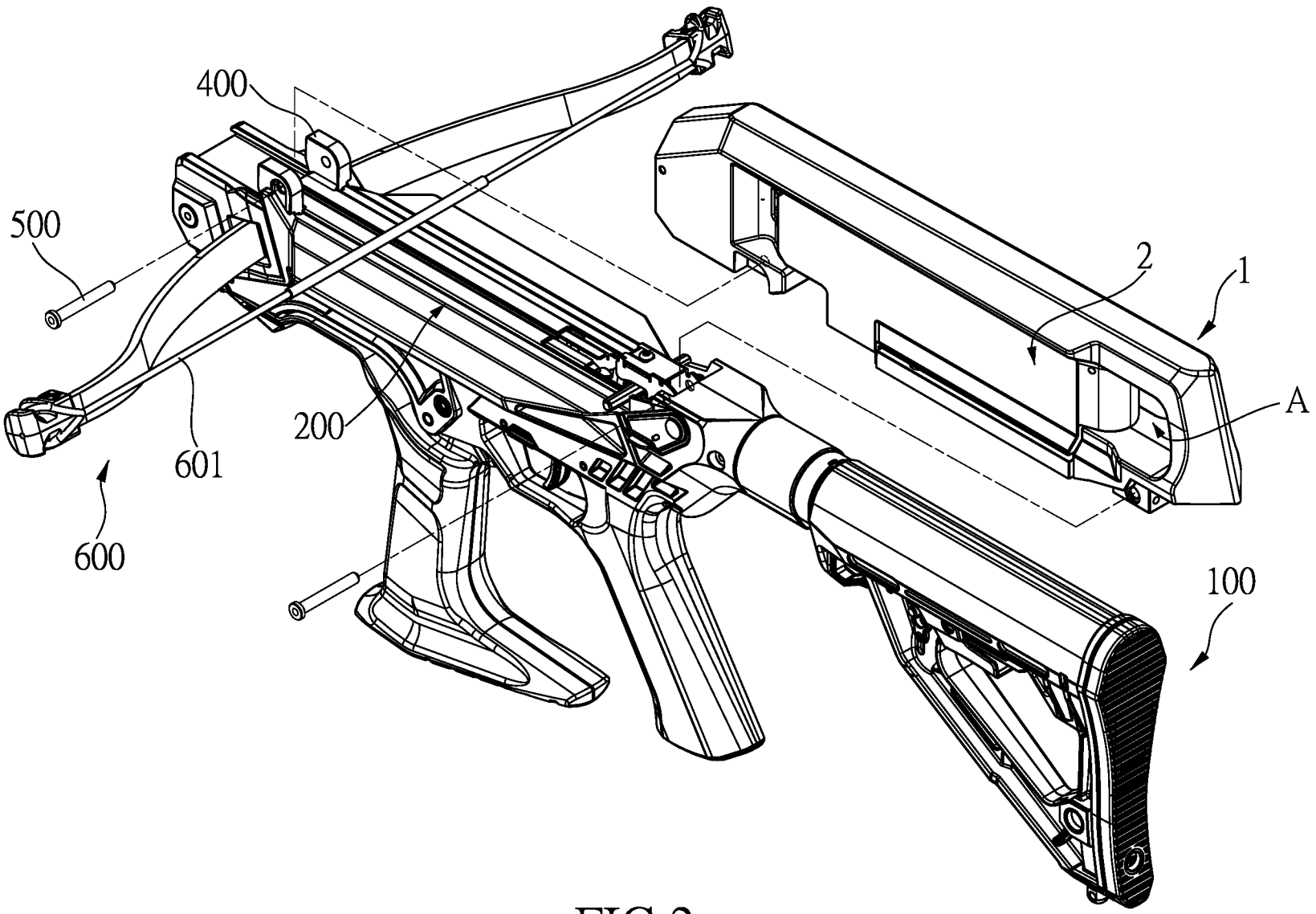
FIG. 2 is a perspective exploded schematic view of the device of the present disclosure and the bow unit.

Referring to FIG. 1, 1A to FIG. 10, the present disclosure provides an arrow magazine replacing device disposed on an arrow portion 200 of a bow unit 100. The arrow magazine replacing device includes: a frame member 1 in an inverted U-shape, mounted on the arrow portion 200 of the bow unit 100, the frame member 1 includes a mounting part 10 being hollow on one side toward the other side; and an arrow magazine unit 2, detachably assembled and disassembled in the mounting part 10. The arrow magazine unit 2 can be detachably assembled and disassembled on the frame member 1, so that the arrow magazine unit 2 replacement time can be shortened, and the stability and accuracy during shooting can be maintained.

Based on the above description, the user can prepare several arrow magazine units 2 filled with a plurality of arrows 300 in advance, and assemble one of the arrow magazine unit 2 in the mounting part 10 to start repeating shooting. After the arrows 300 in the arrow magazine unit 2 assembled on the mounting part 10 is completely shot, the user can apply external force to the arrow magazine unit 2, such as pushing, turning, pulling, flapping, etc., and the arrow magazine unit 2 will be detached from the frame member 1. Then another arrow magazine unit 2 filled with arrows 300 is assembled into the mounting part 10, and the repeating shooting can be restarted. No additional hand tools or special tools for disassembly and assembly are required in the entire process. The arrow magazine unit 2 can be quickly assembled into the mounting part 10 of the frame member 1 by a simple and easy step (the disassembly and assembly can even be shortened in just a few seconds after practice). Further, the user can disassemble and replace the arrow magazine unit 2 under the shooting posture, so that the accuracy and stability of shooting can be maintained while replacing the arrow magazine unit 2 without the problem of excessive deviation.

Figure 3:
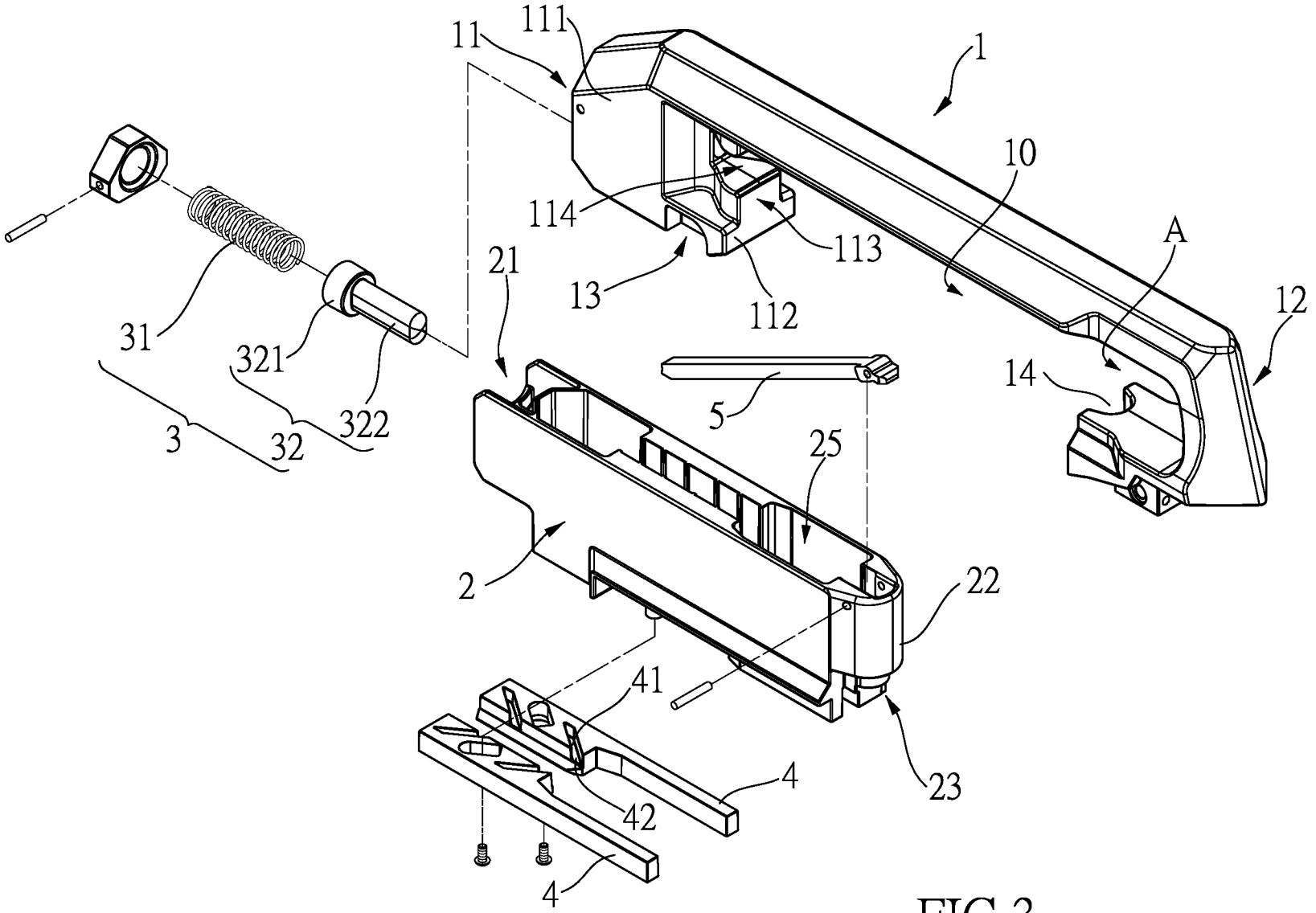
FIG. 3 is a partial exploded schematic view of FIG. 2.
Figure 4:
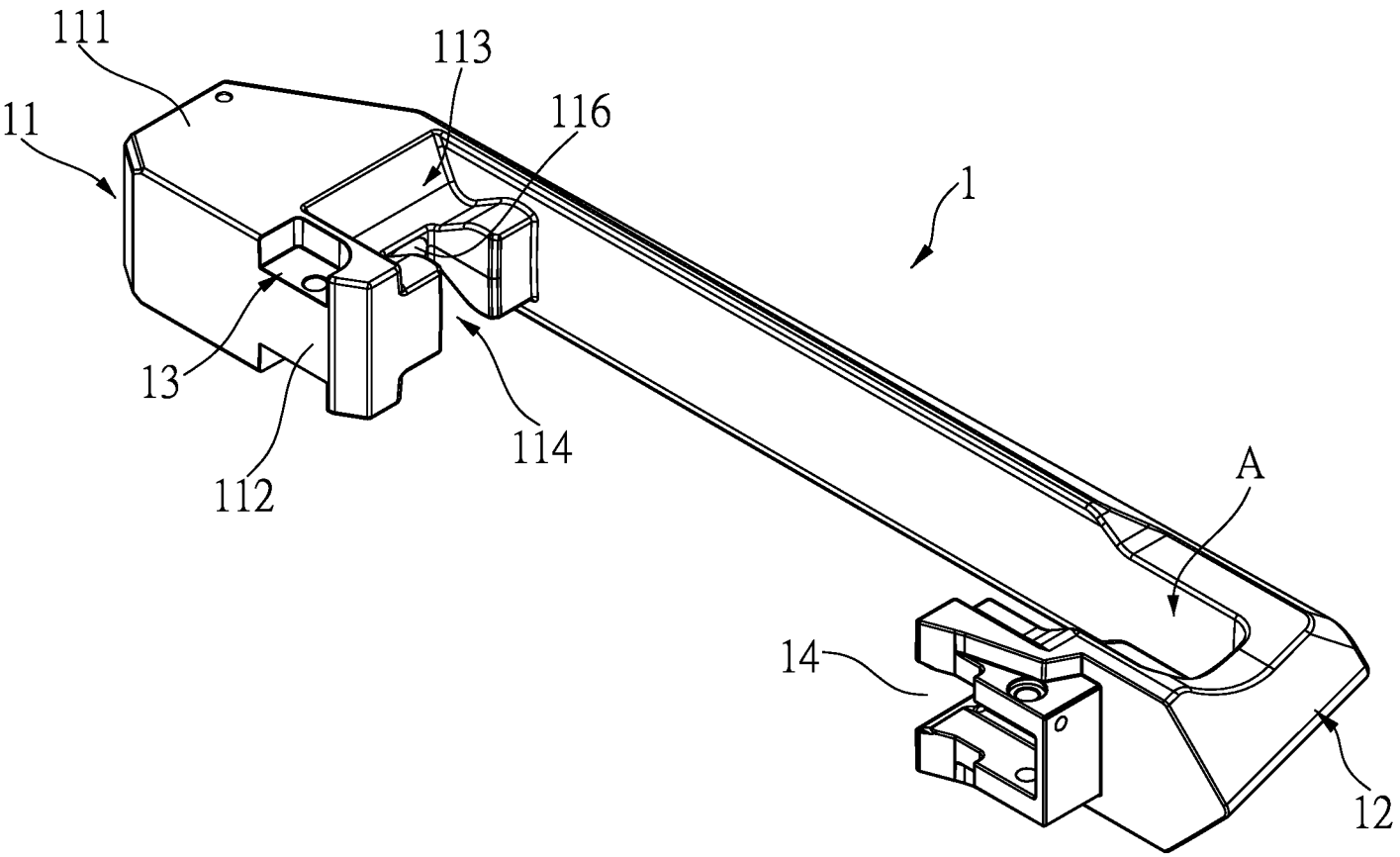
FIG. 4 is a schematic perspective view of another angle of the frame member of the present disclosure.

According to the above description, the detailed technical features of the present disclosure will be further described below. As shown in FIG. 3 and FIG. 4. Regarding the design of the frame member 1 of the present disclosure, in order to ensure that the arrow magazine unit 2 is reliably assembled on the bow unit 100 and the arrow 300 can fall steadily on the arrow portion 200 for shooting, the frame member 1 further includes a front portion 11 and rear portion 12, and the mounting part 10 is located between the front portion 11 and the rear portion 12. The front portion 11 further includes a front concave block 111, a lower baffle block 112 located in the mounting part 10 and connected to the front concave block 111, and a positioning clamp block 113 located in the mounting part 10 and connected to the front concave block 111 and the lower baffle block 112.

Further, the positioning clamp block 113 has a positioning cutout 114 transversely. The positioning cutout 114 is spatial communicated with the mounting part 10. Two locking holes 13 are respectively recessed on two sides of the lower baffle block 112, and each locking hole 13 is engaged with a plurality of convex fins 400 of the arrow portion 200, and a locking bolt 500 is threadedly engaged the locking hole 13 and the convex fins 400. Therefore, the frame member 1 can be fixedly assembled on the arrow portion 200 of the bow unit 100, and allows quick disassembly and assembly of the arrow magazine unit 2 relative to the bow unit 100.

Furthermore, after the frame member 1 is fixedly assembled on the bow unit 100, the replacement of the arrow magazine unit 2 from the frame member 1 is described as follows. Referring to FIG. 3, FIG. 6 to FIG. 9, firstly, regarding disassembling the arrow magazine unit 2, in order to allow the user to replace the arrow magazine unit 2 quickly, the front concave block 111 of the front portion 11 further includes an interior chamber 115 including an opening 116 connected to the positioning cutout 114. Further, an elastic member 3 is partially located inside the interior chamber 115, and partially protrudes from the opening 116, and is located in the positioning cutout 114, so that the part of the elastic member 3 protruding from the opening 116 is movably abutted against the arrow magazine unit 2. Through the elastic member 3 of the present disclosure, the arrow magazine unit 2 can be positioned at the mounting part 10, so that the arrow 300 can accurately fall to the arrow portion 200 and hold for shooting.

Moreover, the elastic member 3 further includes a spring 31 and a push stopper 32. The push stopper 32 has a head segment 321 being limited in the interior chamber 115 and a shank segment 322 connected to the head segment 321. In detail, one end of the shank segment 322 is connected to the head segment 321, and the other end of the shank segment 322 passes through the opening 116 to the positioning cutout 114 and movably abuts the arrow magazine unit 2. One end of the head segment 321 is connected to the shank segment 322, and the other end of the head segment 321 has a notch 323. Further, one end of the spring 31 is abutted against the notch 323, and the other end of the spring 31 is abutted against the wall of the interior chamber 115, so that the spring 31 elastically pushes the shank segment 322 of the push stopper 32 toward the arrow magazine unit 2.

In this way, while the user is disassembling the arrow magazine unit 2, the arrow magazine unit 2 is pushed toward the elastic member 3, (as shown in the direction points by the arrow in FIG. 8, and the opposite direction is to assemble the device) so that the arrow magazine unit 2 is detached from the frame member 1. At the same time, the shank segment 322 is also pushed to indirectly cause the spring 31 to be compressed and elastically accumulate force, and the arrow magazine unit 2 can be detached from the frame member 1 (as shown in the direction points by the arrow in FIG. 9, and the opposite direction is to assemble the device).

On the contrary, when the user wants to assemble the arrow magazine unit 2 in the mounting part 10, the user only requires inserting one end of the arrow magazine unit 2 into the mounting part 10 and pushing the shank segment 322 to the positioning cutout 114, so that the shank segment 322 drives the head segment 321 to compress the spring 31. Thereby, the arrow magazine unit 2 is allowed to assemble into the mounting part 10, and then the spring 31 is reset to indirectly drive the shank segment 322 to abut against the arrow magazine unit 2, so that the arrow magazine unit 2 can be stably fixed in the mounting part 10.

Regarding the disassembly and positioning of the arrow magazine unit 2 mentioned above, firstly, in the design of the arrow magazine unit 2, the arrow magazine unit 2 further includes an arc baffle portion 21 corresponding to the front portion 111 and a switch blocking portion 22 corresponding to the rear portion 12. In detail, when the arrow magazine unit 2 is assembled on the mounting part 10, the shank segment 322 protruding from the opening 116 is abutted against the arc baffle portion 21. The elastic force of the spring 31 is used to indirectly push the shank segment 322 against the arc baffle portion 21 to position the arrow magazine unit 2 in the mounting part 10. Further, an operating space A is formed between the switch blocking portion 22 and the mounting part 10 of the rear portion 12. When the arrow 300 is running out the arrow magazine unit 2 needs to be replaced, the user can hand into the operating space A, and apply an external force to the switch blocking portion 22 of the arrow magazine unit 2 (first push and then pull), the arrow magazine unit 2 can be disassembled from the frame member. The detailed figures can be found in FIG. 1, FIG. 8, and FIG. 9.

In order to prevent the arrow magazine unit 2 from getting stuck when disassembling and assembling it, as shown in FIG. 4, FIG. 7 to FIG. 9, the arc baffle portion 21 further includes an arc concave surface 211, the arc concave surface 211 has a low concave part 211A and two high convex parts 211B located at both ends of the low concave part 211A, and the two high convex parts 211B are closer to the front portion 111 than the low concave part 211A. The shank segment 322 of the elastic member 3 is movable and abutted against the low concave part 211A, and the corner shape of the shank segment 322 of the elastic member 3 that abuts against the low concave part 211A is rounded.

Thereby, the two high convex parts 211B limit the shank segment 322 to abut against the low concave part 211A, so that the arrow 300 in the arrow magazine unit 2 can accurately fall on the arrow portion 200. Further, the rounded corner shape of the shank segment 322 allows the user to smoothly detach the arc baffle portion 21 of the arrow magazine unit 2 along the rounded corner, so that the shank segment 322 and the arc baffle portion 21 will not interfere with each other and are difficult to disassemble.

The same applies to when the arrow magazine unit 2 is assembled in the mounting part 10. The user first pushes the arc baffle portion 21 against the shank segment 322 to compress the spring 31, and then moves it towards the mounting part 10. At this time, the position of the rounded corner of the shank segment 322 matches the curvature of the arc baffle portion 21 to allow the arrow magazine unit 2 to move smoothly, and finally be firmly assembled in the mounting part 10 for positioning.

Regarding the positioning between the arrow magazine unit 2 and the frame member 1, in addition to the spring 31 compress the shank segment 322 to abut against the arc baffle portion 21 of the arrow magazine unit 2, the rear portion 12 of the arrow magazine unit 2 also has a design to fit the frame member 1, as shown in FIG. 4 to FIG. 9. The rear portion 12 of the frame member 1 further includes a rear recess 14, and the bottom surface of the switch blocking portion 22 has a limiting block 23 corresponding to the rear recess 14. When the user disassembles the arrow magazine unit 2, the arrow magazine unit 2 is pushed toward the front portion 11 first, so that the limiting block 23 is disengaged from the rear recess 14. Further, the arrow magazine unit 2 can be detached from the frame member 1 and removed from the mounting part 10 of the frame member 1.

The same applies to assembling the arrow magazine unit 2, when the arrow magazine unit 2 is assembled on the mounting part 10, the spring 31 compresses the arrow magazine unit 2 to move toward the rear portion 12, so that the limiting block 23 is fittingly engaged with the rear recess 14. Through the force of the spring 31, the arrow magazine unit 2 can be stably assembled in the mounting part 10 of the frame member 1.

Figure 5:
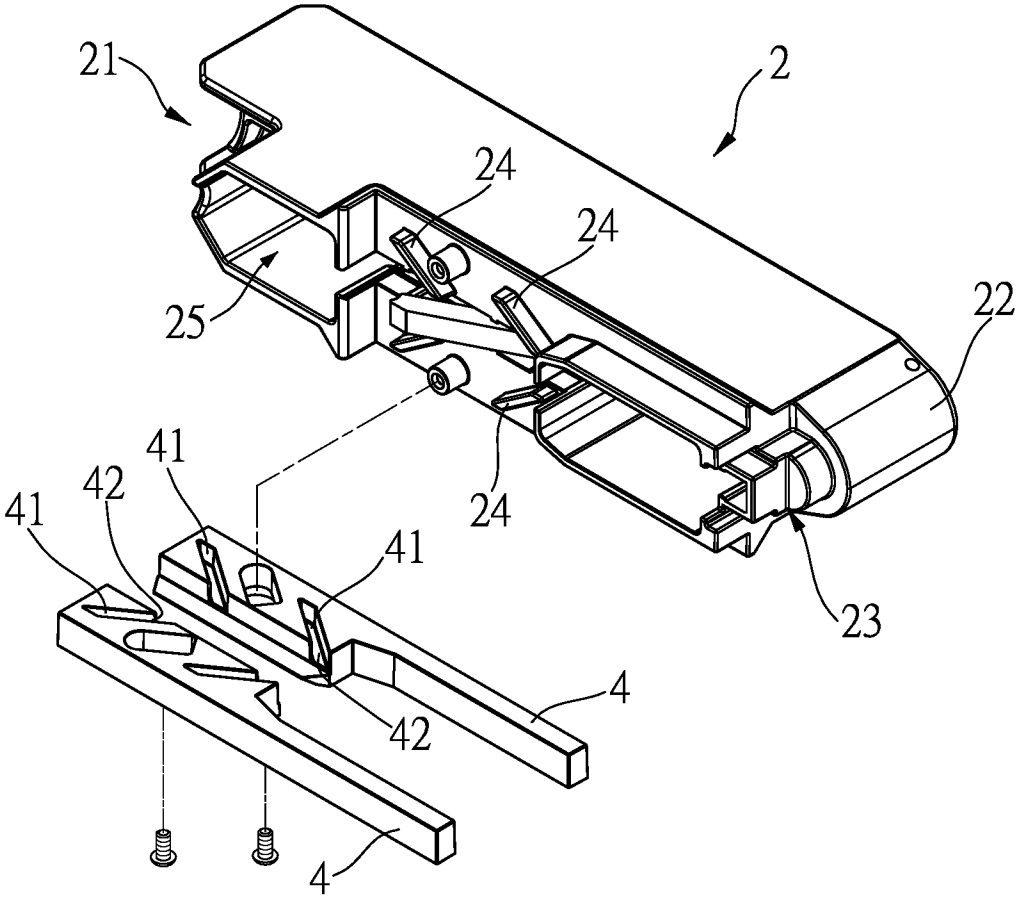
FIG. 5 is a schematic perspective view of another angle of the arrow magazine unit of the present disclosure.
Figure 6:
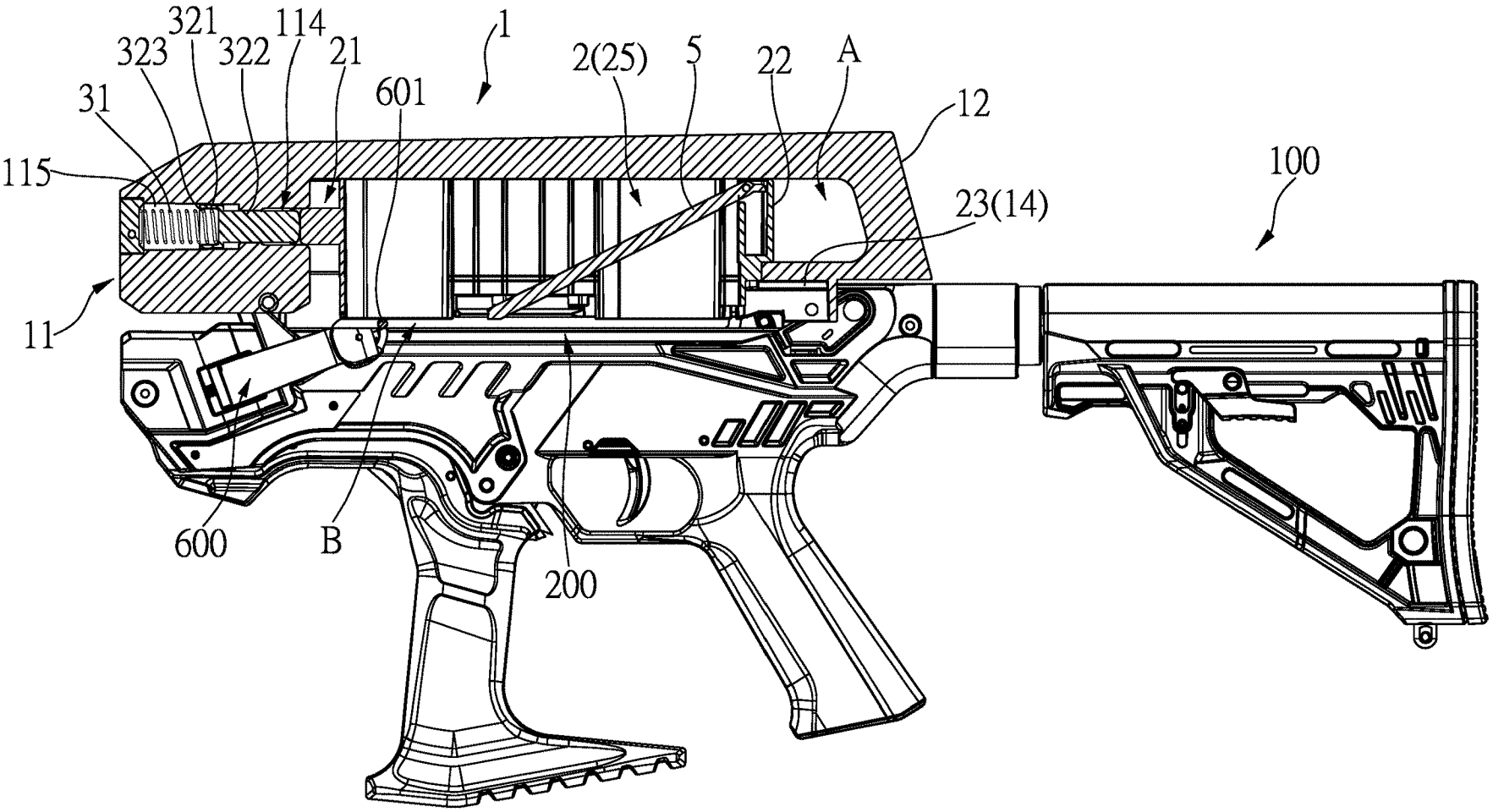
FIG. 6 is a partial sectional schematic view of line VI-VI of FIG. 1.
Figure 7:
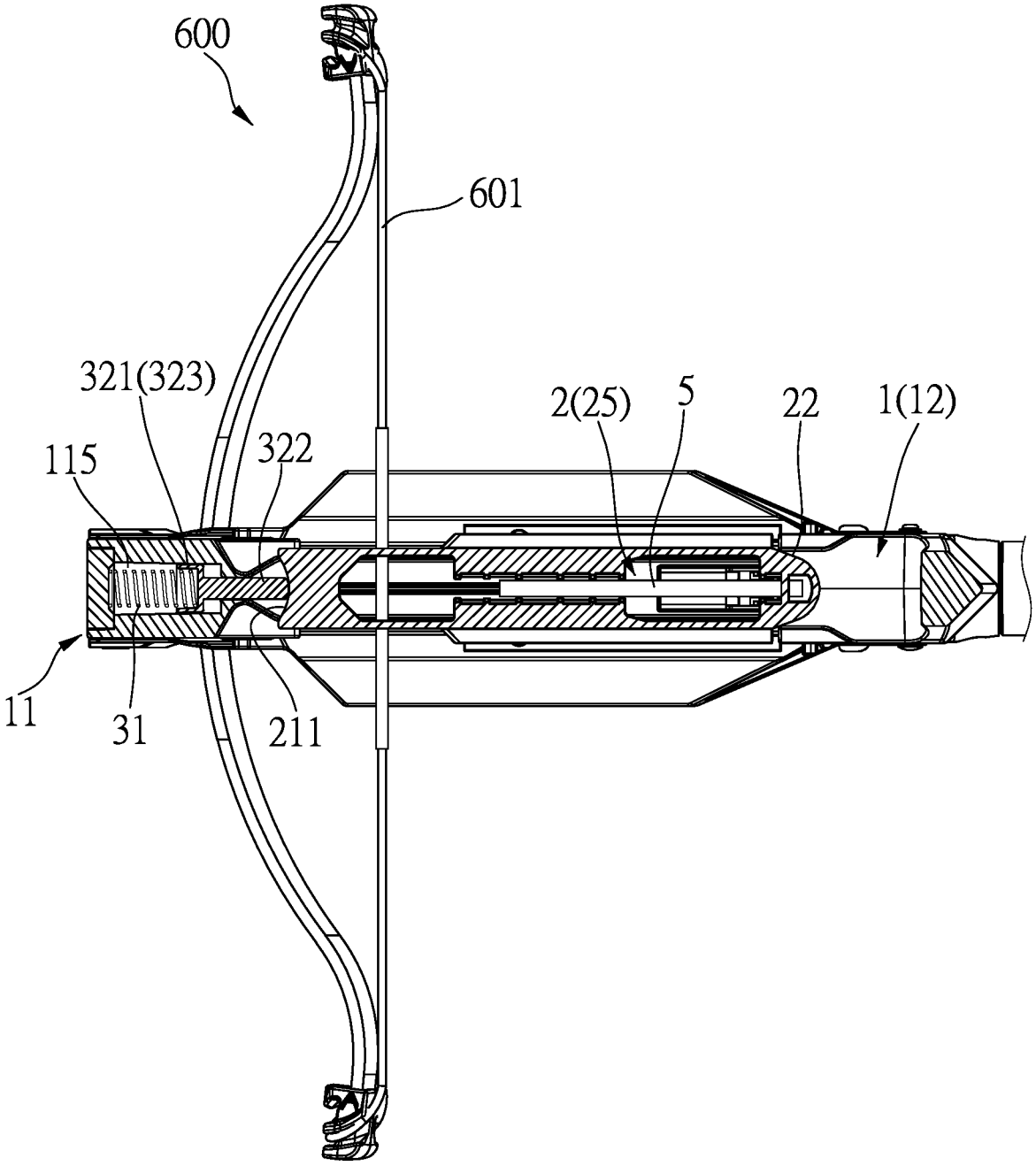
FIG. 7 is a sectional schematic view of line VII-VII of FIG. 1.
Figure 7A:
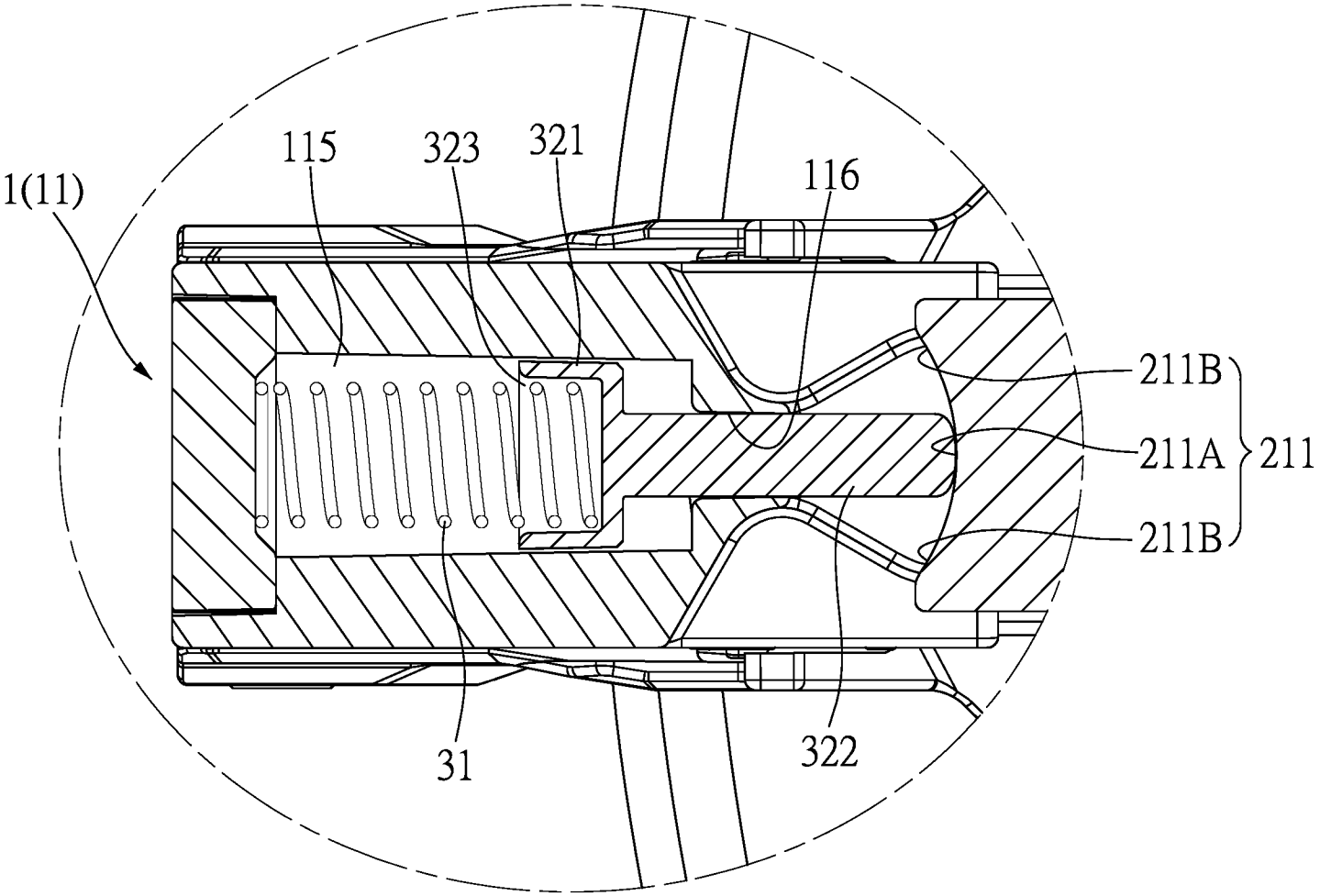
FIG. 7A is a partial enlarged schematic view of FIG. 7.
Figure 8:
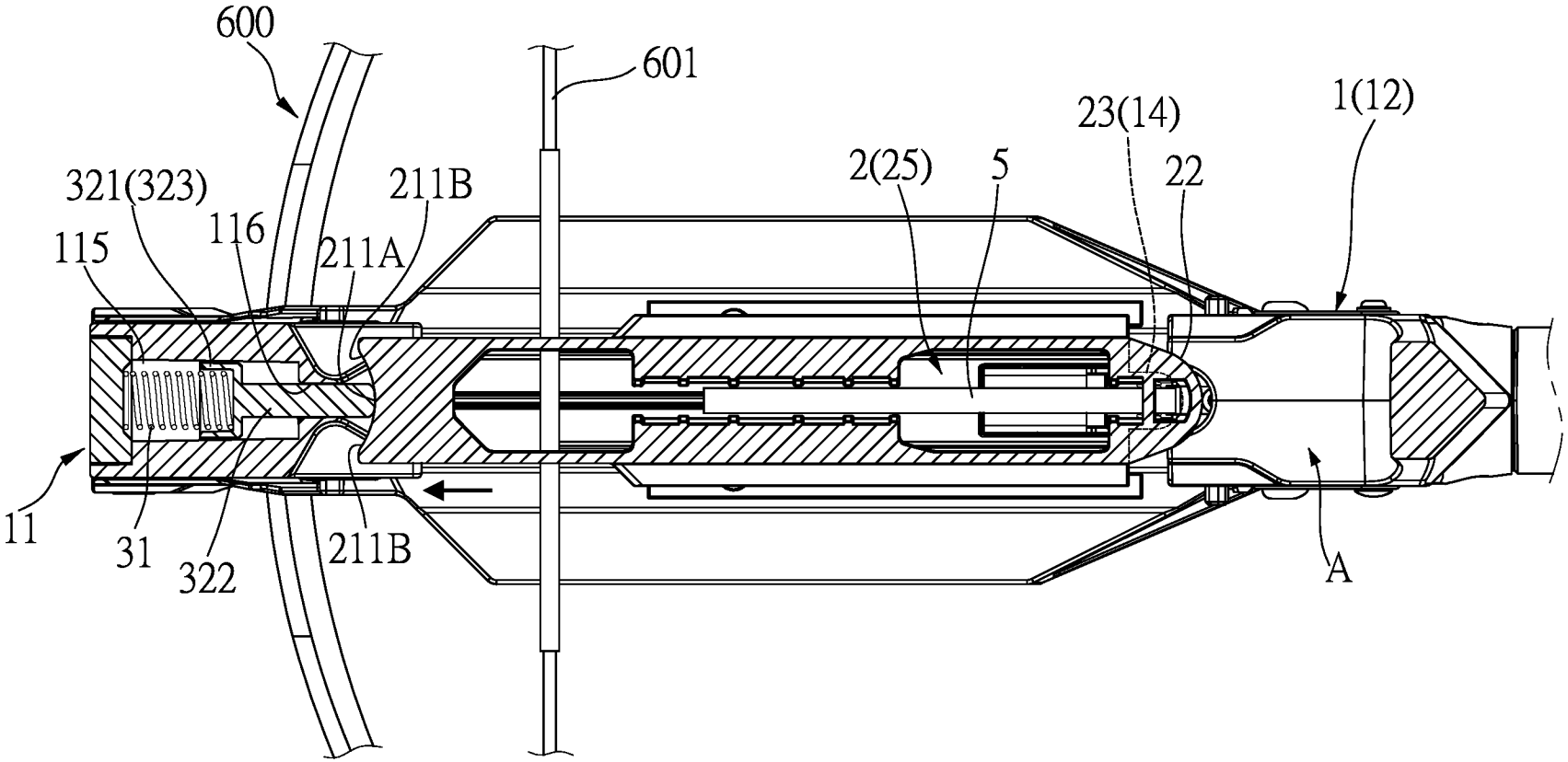
FIG. 8 is a schematic view of the movement of disassembling the arrow magazine unit.
Figure 9:
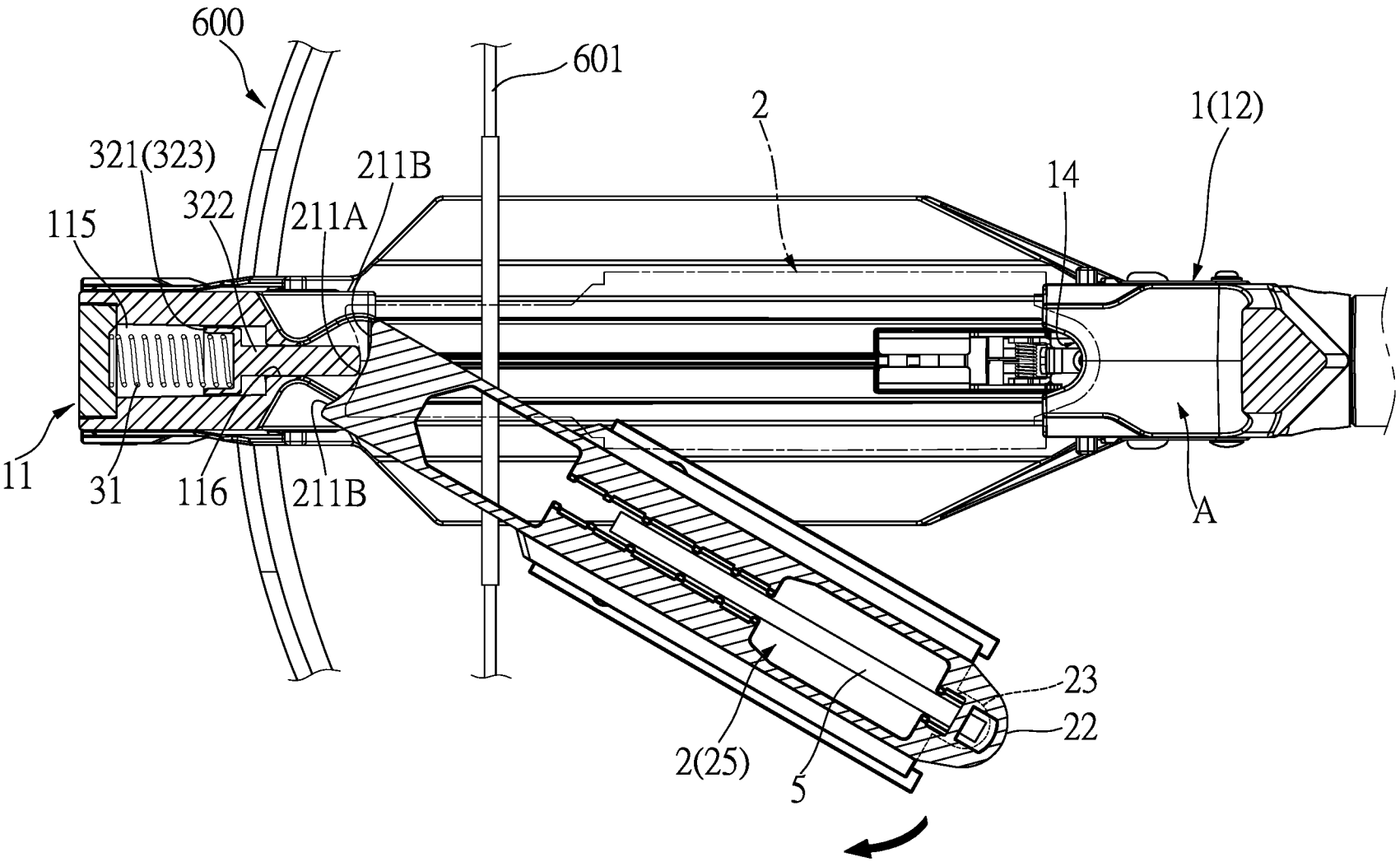
FIG. 9 is a schematic view of the movement of disassembling the arrow magazine unit.
Figure 10:
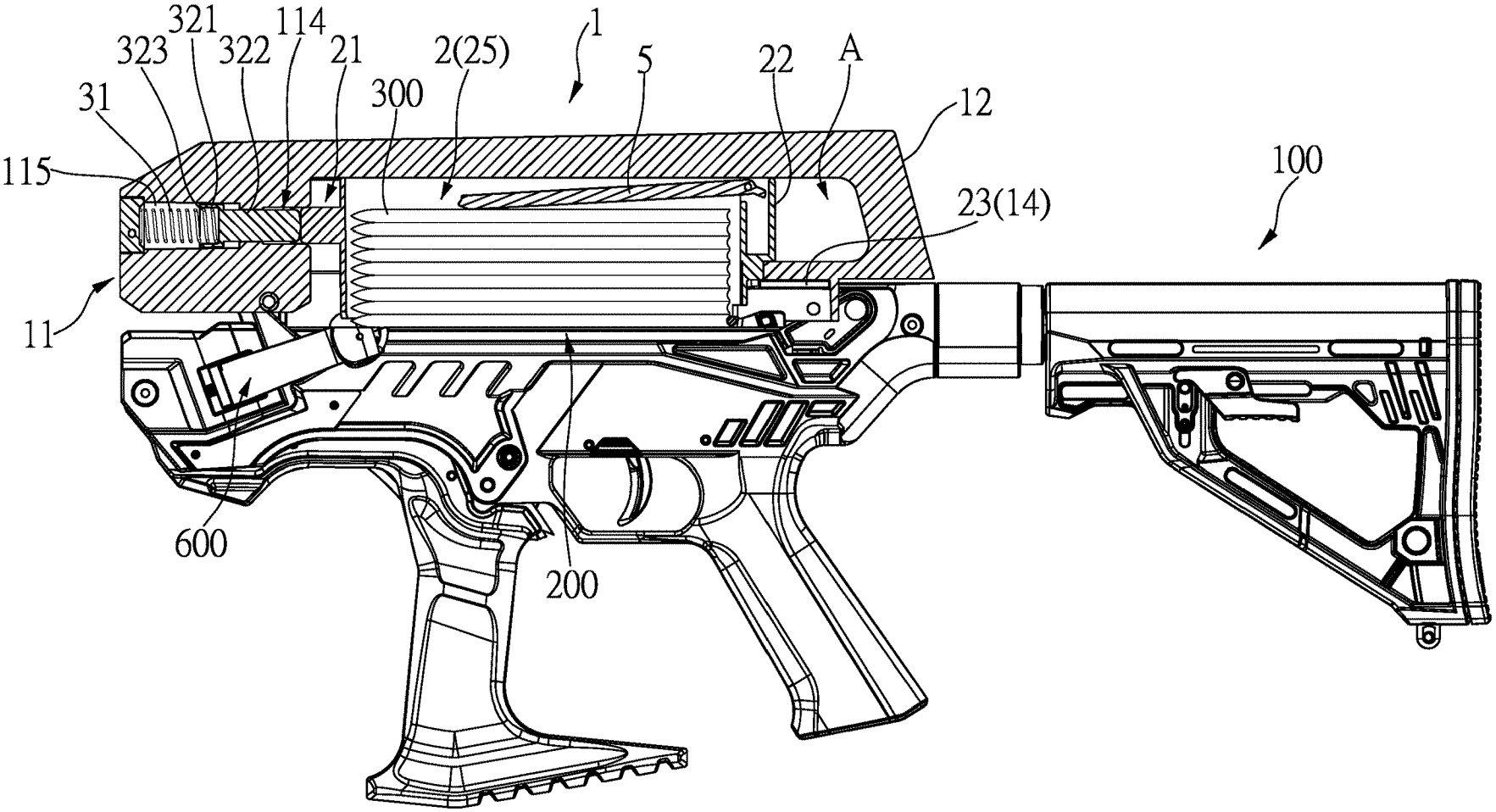
FIG. 10 is a schematic view of the arrow groove of the arrow magazine unit is filled with a plurality of arrows in practice.
Figure 11:
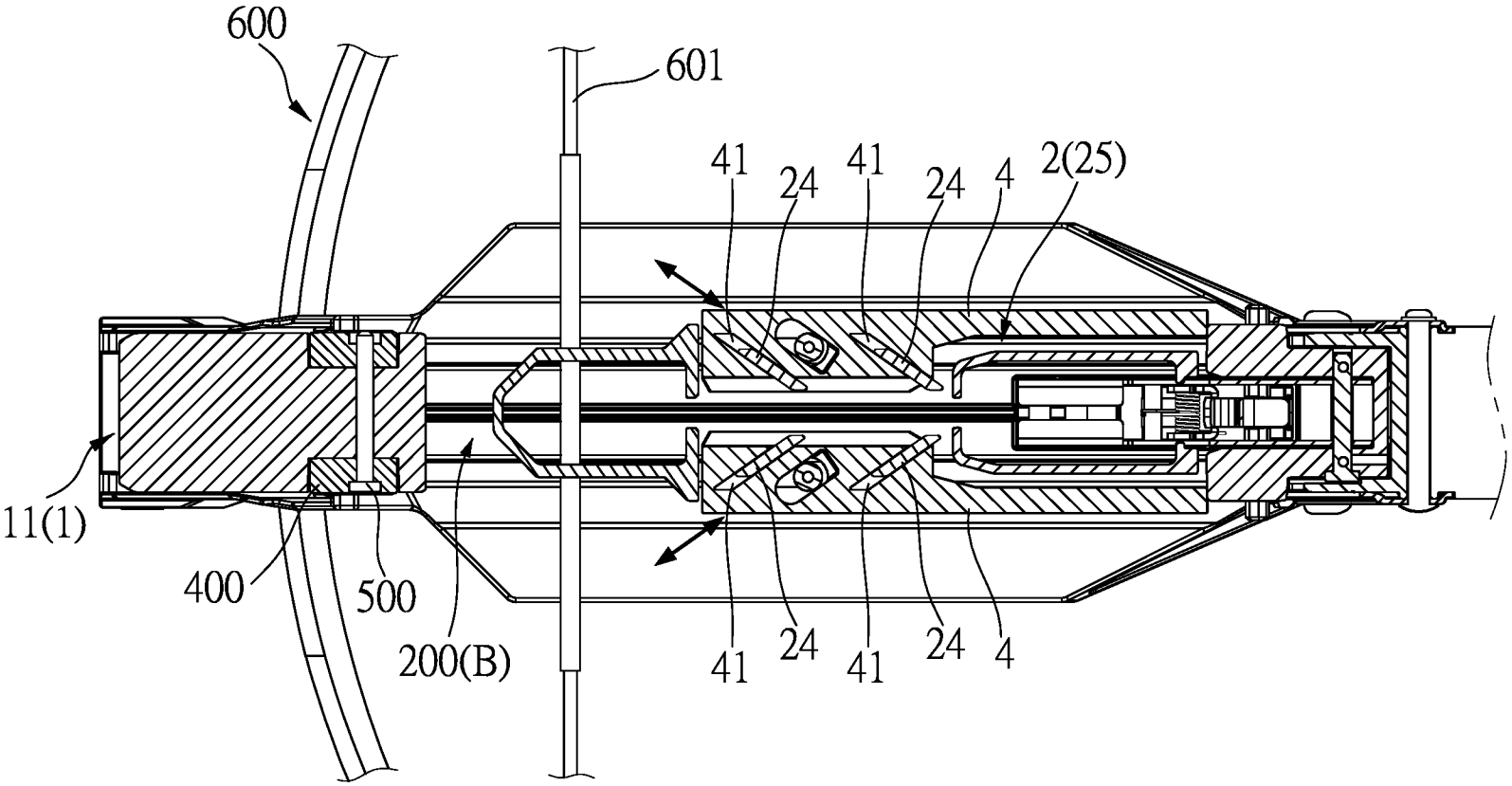
FIG. 11 is a sectional schematic view of line XI-XI of FIG. 1.

The arrows 300 on the market are divided into different sizes. In addition to the length, there are also differences in the thickness of the arrow shaft. Therefore, the device of the present disclosure allows various kinds of arrows 300, arrow magazine unit 2, and the bow unit 100 to be used in conjunction with each other. As shown in FIG. 5, FIG. 10, and FIG. 11, the arrow magazine unit 2 further includes a plurality of limiting fins 24, and two limiting plates 4 disposed at the bottom of the arrow magazine unit 2. The two limiting plates 4 are spaced apart to provide through space for dropping the arrow 300, and each of the limiting plate 4 has a plurality of recessed slots 41 corresponding to the limiting fins 24. Further, each of the recessed slot 41 has a sliding opening 42, so that the limiting fin 24 moves slidably in the corresponding recessed slot 41. In addition, the user can adjust the space between the two limiting plates 4 of the arrow magazine unit 2 according to the size of the arrow 300, so that the arrow 300 can be limited and smoothly fall into the arrow portion 200 in a unified manner without rotating.

Furthermore, the arrow magazine unit 2 further includes an arrow groove 25 through the top to the bottom of the arrow magazine unit 2, and the arrow groove 25 is communicated with the arrow portion 200 of the bow unit 100. The arrow groove 25 has a pressing member 5, the arrow groove 25 is filled with a plurality of arrows 300 arranged in a stack, and one end of the pressing member 5 is elastically pressed against the uppermost arrow 300 among the plurality of arrows 300 disposed in the arrow groove 25, so that the pressing member 5 elastically pushes the plurality of arrows 300 into the arrow portion 200 for shooting. The arrow magazine unit 2 is assembled at the mounting part 10 to form a shooting space B with the arrow portion 200. A bow string 601 of a bow string set 600 of the bow unit 100 is movably located in the shooting space B, and the bow string 601 shoots the arrow 300 that falls into the arrow portion 200 from the arrow groove 25.

What is claimed is:

1. An arrow magazine replacing device, disposed on an arrow portion of a bow unit, the arrow magazine replacing device comprising:

a frame member, mounted on the arrow portion of the bow unit, the frame member includes a mounting part being hollow on one side toward the other side; and an arrow magazine unit, detachably assembled and disassembled in the mounting part.

2. The arrow magazine replacing device according to claim 1, wherein the frame member further includes a front portion and rear portion, and the mounting part is located between the front portion and the rear portion; wherein the front portion has an elastic member elastically resists and limits the arrow magazine unit in the mounting part.

3. The arrow magazine replacing device according to claim 2, wherein the arrow magazine unit further includes an arc baffle portion corresponding to the front portion and a switch blocking portion corresponding to the rear portion; wherein when the arrow magazine unit is assembled on the mounting part, the elastic member is abutted against the arc baffle portion; wherein an operating space is formed between the switch blocking portion and the mounting part of the rear portion, by applying an external force to the arrow magazine unit from the operating space, the arrow magazine unit can be disassembled from the frame member.

4. The arrow magazine replacing device according to claim 3, wherein the arc baffle portion further includes an arc concave surface, the arc concave surface has a low concave part and two high convex parts located at both ends of the low concave part, and the two high convex parts are closer to the front portion than the low concave part; wherein the elastic member is movable abutted against the low concave part, and the corner shape of the elastic member that abuts against the low concave part are rounded.

5. The arrow magazine replacing device according to claim 2, wherein the front portion further includes a front concave block, a lower baffle block located in the mounting part and connected to the front concave block, and a positioning clamp block located in the mounting part and connected to the front concave block and the lower baffle block; wherein the positioning clamp block has a positioning cutout transversely.

6. The arrow magazine replacing device according to claim 5, wherein two locking holes are respectively recessed on two sides of the lower baffle block; wherein each locking hole is engaged with a plurality of convex fins of the arrow portion, and a locking bolt is threadedly engaged the locking hole and the convex fins.

7. The arrow magazine replacing device according to claim 5, wherein the front concave block of the front portion further includes an interior chamber including an opening connected to the positioning cutout; wherein the elastic member is partially located inside the interior chamber, and partially protrudes from the opening and is located in the positioning cutout, so that the part of the elastic member protruding from the opening is movably abutted against the arrow magazine unit.

8. The arrow magazine replacing device according to claim 7, wherein the elastic member further includes a spring and a push stopper; wherein the push stopper has a head segment being limited in the interior chamber and a shank segment connected to the head segment; wherein one end of the shank segment is connected to the head segment, and the other end of the shank segment passes through the opening to the positioning cutout and movably abuts against the arrow magazine unit; wherein one end of the head segment is connected to the shank segment, and the other end of the head segment has a notch; wherein one end of the spring is abutted against the notch, and the other end of the spring is abutted against the wall of the interior chamber, so that the spring elastically pushes the shank segment of the push stopper toward the arrow magazine unit.

9. The arrow magazine replacing device according to claim 3, wherein the rear portion further includes a rear recess, and the bottom surface of the switch blocking portion has a limiting block corresponding to the rear recess, so that when the arrow magazine unit is assembled on the mounting part, the limiting block is fittingly engaged with the rear recess.

10. The arrow magazine replacing device according to claim 1, wherein the arrow magazine unit further includes an arrow groove through the top to the bottom of the arrow magazine unit, and the arrow groove is communicated with the arrow portion of the bow unit; wherein the arrow groove has a pressing member, the arrow groove is filled with a plurality of arrows arranged in a stack, and one end of the pressing member is elastically pressed against the uppermost arrow among the plurality of arrows disposed in the arrow groove, so that the pressing member elastically pushes the plurality of arrows into the arrow portion for shooting.

11. The arrow magazine replacing device according to claim 10, wherein the arrow magazine unit further includes a plurality of limiting fin, and two limiting plates disposed at the bottom of the arrow magazine unit; wherein the two limiting plates are spaced apart to provide through space for the arrow groove and the arrow portion, and each of the limiting plates has a plurality of recessed slots corresponding to the limiting fins; wherein each of the recessed slot has a sliding opening, so that the limiting fin moves slidably in the corresponding recessed slot.

12. The arrow magazine replacing device according to claim 10, wherein the arrow magazine unit is assembled at the mounting part to form a shooting space with the arrow portion; wherein a bow string of a bow string set of the bow unit is movably located in the shooting space, and the bow string shoots the arrow that falls into the arrow portion from the arrow groove.

* * * * *